US007296530B1

(12) United States Patent
Bernstein et al.

(10) Patent No.: US 7,296,530 B1
(45) Date of Patent: Nov. 20, 2007

(54) UNMANNED SYSTEM FOR UNDERWATER OBJECT INSPECTION, IDENTIFICATION AND/OR NEUTRALIZATION

(75) Inventors: Charles Bernstein, Panama City, FL (US); John Dudinsky, Panama City, FL (US); Paul Moser, Panama City, FL (US); Daniel Kucik, Panama City, FL (US); Doug Freeman, Panama City, FL (US); David Jennings, Panama City, FL (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 163 days.

(21) Appl. No.: 11/311,760

(22) Filed: Dec. 12, 2005

(51) Int. Cl.
*B63G 8/41* (2006.01)
*B63C 7/00* (2006.01)

(52) U.S. Cl. ..... 114/322; 114/51

(58) Field of Classification Search ..... 114/51, 114/321, 322, 258
See application file for complete search history.

(56) References Cited

U.S. PATENT DOCUMENTS 3,880,103 A * 4/1975 Talkington ..... 405/185
4,010,619 A * 3/1977 Hightower et al. ..... 405/191
5,235,931 A * 8/1993 Nadolink ..... 114/321

* cited by examiner

*Primary Examiner*—Jesús D Sotelo
(74) *Attorney, Agent, or Firm*—James T. Shepherd

(57) ABSTRACT

An unmanned system performs inspection, identification and/or neutralization of underwater objects. An unmanned vehicle that operates at a water's surface stows underwater crawling and/or swimming vehicles that can operate underneath a water's surface. A winch associated with each robotic vehicle is mounted on the unmanned vehicle. An electro-mechanical tether electrically and mechanically couples a corresponding robotic vehicle to the unmanned vehicle, and is mechanically coupled to a corresponding winch for control of the paying out and reeling in thereof.

18 Claims, 3 Drawing Sheets

UNMANNED SYSTEM FOR UNDERWATER OBJECT INSPECTION, IDENTIFICATION AND/OR NEUTRALIZATION

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to the inspection, identification and neutralization of underwater objects, and more particularly to an unmanned system for underwater object inspection, identification and/or neutralization.

BACKGROUND OF THE INVENTION

Current Navy methods for reacquisition, identification and neutralization (RIN) of mines in very shallow water (i.e., 10-40 feet) and surf zone (i.e., 0-10 feet) utilize divers and/or marine mammals (e.g., dolphins and sea lions) to relocate contacts found by mine search sonars and to deploy countercharges to destroy the mines. These approaches risk personnel who must enter the minefields and endanger themselves by being visible on the surface from enemy shores, and by having to work around mines while in moving currents and waves.

Recently, unmanned vehicles have been used to search for and neutralize mines. Unmanned underwater vehicles (UUVs) that swim in the water column are currently in the fleet for performing search, classify and mapping (SCM) missions. These swimming vehicles are ideal for carrying side-scan sonar to perform wide area reconnaissance of minefields. They can efficiently scan large areas and map mine-like sonar contacts. Under ideal conditions, UUVs can identify sonar contacts using cameras or specialized imaging sonars. However, it is difficult for UUVs to place countercharges on the mines or to identify them under poor optical or acoustic conditions. In addition, UUVs generally rely on acoustic navigation aids which must be pre-positioned within the minefield before the vehicles can function. The UUVs must be delivered near to or into the minefields by personnel in boats thereby endangering the delivery personnel.

Bottom-crawling robots (i.e., "crawlers") provide a stable base for identifying and prosecuting mines that were contacted by a UUV and are thus ideal for performing the RIN mission. A crawling robot can approach an object and apply sensors (e.g., image the object) at contact range. The natural stability of the crawler and the fact that it moves along the bottom offers the opportunity to exploit new target features for identification of mine-like contacts. The crawler can neutralize mines easily by dropping a countercharge or by serving as a sacrificial, mobile countercharge.

However, crawlers cannot transit long distances. Further, they can easily become stuck while transiting over rough bottoms. Still further, because of their limited energy, personal in boats must deliver the crawlers into or close to the minefields. For these reasons, crawlers have been considered only for limited use for performing mine neutralization missions.

Vehicles that can both swim and crawl have limited payload, speed, and range capabilities. The limitations derive mostly from the physics of buoyancy since it is necessary for the vehicle to release either ballast or buoyancy material to enable it to swim or to be heavy enough to navigate along the bottom and stay in place to neutralize a mine.

SUMMARY OF THE INVENTION

Accordingly, it is an object of the present invention to provide an unmanned system that can efficiently and effectively perform one or more of inspection, identification and neutralization of underwater objects.

Other objects and advantages of the present invention will become more obvious hereinafter in the specification and drawings.

In accordance with the present invention, an unmanned system performs inspection, identification and/or neutralization of underwater objects. At least one remotely-operated robotic vehicle is provided that can operate underneath a water's surface. Each robotic vehicle has a slave controller, electrical propulsion system, underwater sensors, and is equipped for explosive charge deployment. An unmanned vehicle that operates at a water's surface includes a mother controller, self-propulsion, navigation, wireless communication, electrical energy generation systems as well as the ability to stow each robotic vehicle. A winch associated with each robotic vehicle is mounted on the unmanned vehicle. An electro-mechanical tether electrically and mechanically couples a corresponding robotic vehicle to the unmanned vehicle. Each tether is also mechanically coupled to a corresponding winch for control of the paying out and reeling in thereof. Each tether electrically couples the unmanned vehicle's to the robotic vehicle for electrical energy and control signal transfer thereto.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
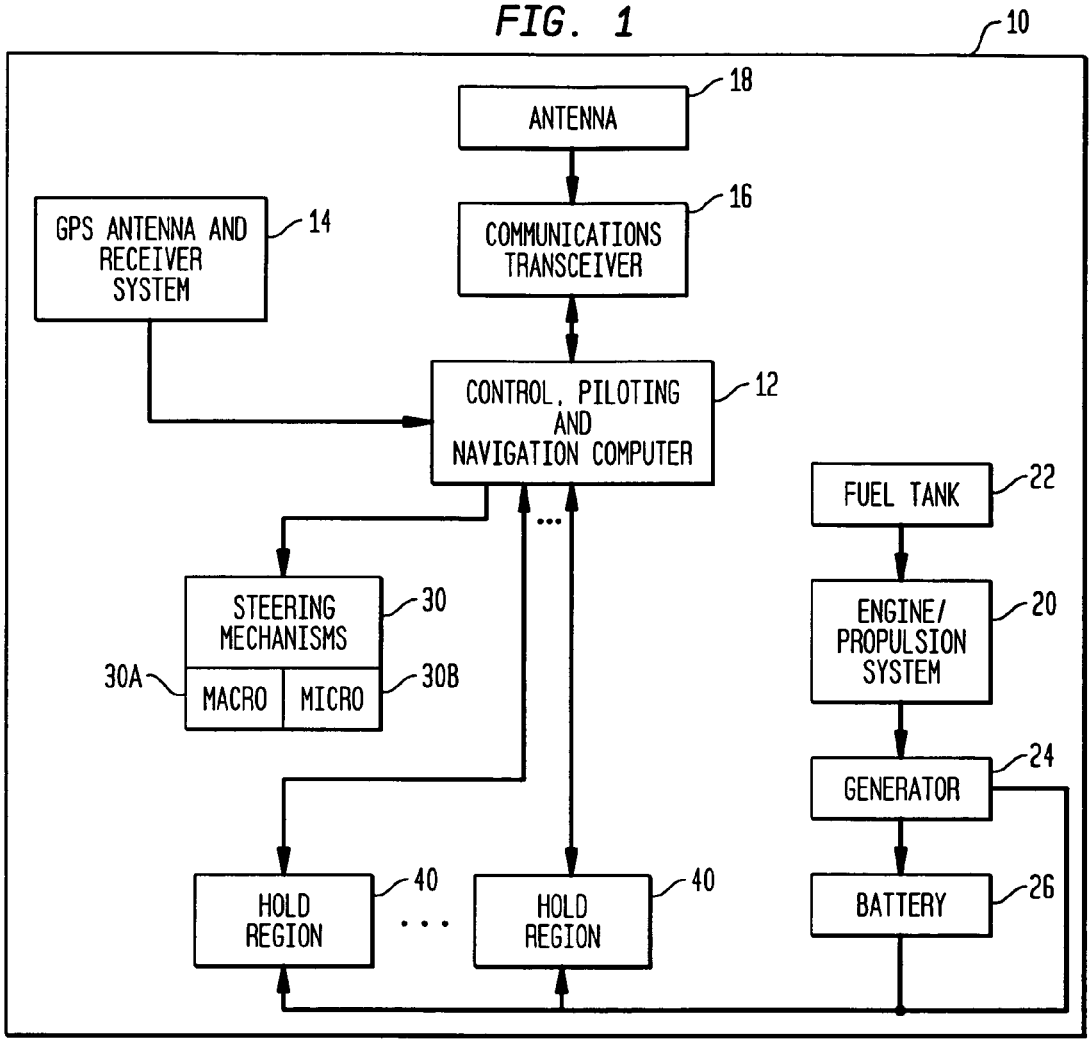
FIG. 1 is a block diagram of the systems maintained onboard an unmanned surface vehicle in accordance with the present invention.
Figure 2:
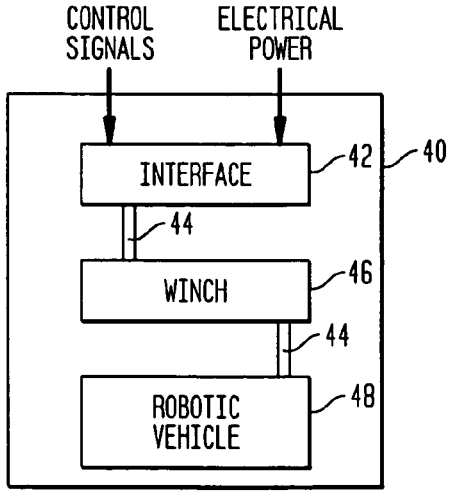
FIG. 2 is a block diagram of the systems maintained in each of the surface vehicle's hold regions.
Figure 3:
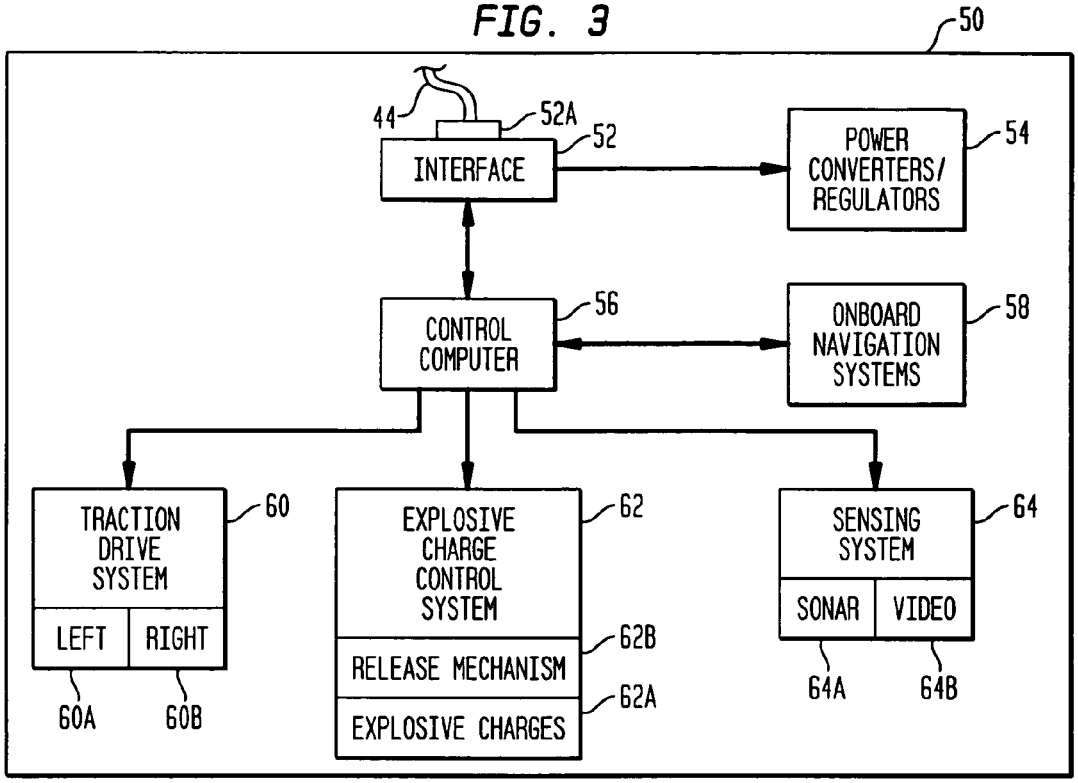
FIG. 3 is a block diagram of the systems maintained onboard an unmanned bottom crawling vehicle transported and deployed by the unmanned surface vehicle in accordance with the present invention.

The present invention is an unmanned system that can be used to inspect, identify and/or neutralize a variety of underwater objects (e.g., underwater mines, unexploded ordnance, pipelines, or other underwater objects). In general, the unmanned system can deploy from a remote location and travel relatively long distances on the water, deploy one or more robotic vehicles therefrom to perform underwater operations as controlled from the water's surface, and retrieve the robotic vehicle(s) for return travel to a remote location. More specifically, the present invention includes an unmanned surface vehicle or boat that can stow one or (typically) more robotic vehicles while in transit to an area of interest, deploy and control the robotic vehicles using systems maintained on the boat, and ultimately retrieve and stow the robotic vehicles. Accordingly, FIGS. 1-3 depict block diagrams of the boat's capabilities (FIG. 1) and the capabilities of two different types of robotic vehicles (FIGS. 2 and 3). By way of example, the present invention will be described for its use in the inspection, identification, and neutralization of underwater mines.

Referring first to FIG. 1, a boat 10 and its various functional systems are illustrated in block diagram form. Boat 10 can be realized by a variety of different designs, one of which will be described later herein. At the heart of the functional capability of boat 10 is its control, piloting and navigation computer 12 that supports and/or controls the various systems coupled thereto. Since boat 10 must be capable of relatively long-distance navigated travel on the water, a GPS antenna and receiver system 14 provide GPS location data to computer 12. The GPS location data could be used by computer 12 to automatically implement a pre-determined navigation plan. Additionally or alternatively, the GPS location data can be provided to a communications transceiver 16 for wireless transmission over the airwaves by a communications antenna 18. In this way, the GPS location data could be monitored at a remote location or used by an operator at a remote location to pilot boat 10 from the remote location. That is, the operator could wirelessly transmit navigation control signals to boat 10 (i.e., via antenna 18 and transceiver 16) based on the GPS location data.

Boat 10 must be able to propel itself to and from locations of interest, and further provide operational power to the one or more robotic vehicles that it supports. Accordingly, boat 10 must be capable of generating its own mechanical and electrical power as well as operational power for its robotic vehicles. One way of achieving this is for boat 10 to have a conventional air-breathing engine/propulsion system 20 onboard, a fuel tank 22 supplying fuel to engine 20, and a generator 24 coupled to engine/propulsion system 20. In this way, engine/propulsion system 20 provides mechanical power for propulsion of boat 10 and for generator 24 which converts mechanical power to electrical power. A battery 26 could be coupled to generator 24 to store excess electrical power and/or to provide regulated power for those systems onboard boat 10.

In addition to engine/propulsion system 20, boat 10 will be equipped with steering mechanisms 30 controlled by computer 12. Such mechanisms 30 would typically include both macro steering mechanisms 30A (e.g., rudders) and micro steering mechanisms 30B (e.g., side thrusters). Macro steering control is implemented when boat 10 is traveling to and from an area of interest. Micro steering control is implemented when boat 10 is "on station" at an area of interest with its robotic vehicle(s) deployed in the water as will be explained further below.

As previously mentioned, boat 10 is equipped to stow one or more robotic vehicles during travel to and from an area of interest. The robotic vehicles can be "bottom crawling" vehicles capable of traversing the bottom of a body of water, and/or "swimming vehicles" capable of controlled movement under the water's surface. Accordingly, boat 10 has hold region(s) 40, each of which can stow, deploy and retrieve one robotic vehicle. Control signals for hold regions 40 are provided by computer 12 while electrical power is supplied by one or both of generator 24 and battery 26. Since each hold region 40 will be similarly equipped, only one such hold region 40 will be described with the aid of FIG. 2.

Referring now to FIG. 2, an interface 42 in hold region 40 receives both control signals and electrical power as illustrated in FIG. 1. An electro-mechanical tether 44 is coupled on one end thereof to interface 42 and is coiled about a winch 46. The other end of tether 44 is coupled to a robotic vehicle 48. Upon reaching an area of interest, boat 10 can deploy robotic vehicle 48 by paying out tether 44 using winch 46, power and control robotic vehicle 48 during its mission, and then reel in tether 44 using winch 46.

Robotic vehicle 48 can be either a bottom crawling or swimming vehicle. The drive system associated with a bottom crawling vehicle will be different from that of a swimming vehicle. Accordingly, the systems maintained onboard a (robotic) bottom crawling vehicle and swimming vehicle will be explained with the aid of FIGS. 3 and 4, respectively.

In FIG. 3, a bottom crawling vehicle 50 has an interface 52 to which tether 44 is coupled. Electrical power provided via tether 44 is directed to power converters/regulators 54 which, in turn, provides the necessary electrical power for the systems onboard vehicle 50. Operational and navigation control signals can be provided by computer 12 (onboard boat 10) and directed to a control computer 56. In this scenario, computer 12 functions as a "mother controller" to computer 56 while computer 56 functions as a "slave controller" to computer 12. Optionally, onboard navigation systems 58 (e.g., long baseline navigation, local navigation sensors such as gyros, inclinometers, odometers, compass, etc.) can be provided and coupled to computer 56 to supplement the navigation control received from boat 10.

Computer 56 provides local control signal distribution to an electrically-driven traction drive system 60, an explosive charge control system 62, and a sensing system 64. For controlled movement on the water's bottom, traction drive system 60 would typically include individually-controllable left and right traction drives 60A and 60B. A variety of such systems are known in the art of ground traversing vehicles. Sensing system 64 would typically include one or more sonar sensors 64A and a video camera 64B. Outputs from sensor system 64 are provided to computer 56 for use thereby or for ultimate wireless transmission by boat 10 to a remote operator.

Once bottom crawling vehicle 50 is on the sea floor, sensing system 64 is activated/used to (i) acquire/reacquire an object of interest, and (ii) provide inspection information (e.g., sonar data, video data) to one or more of computer 56, computer 12 or a remotely-located operator so that an object of interest can be identified. If it is determined that the identified object should be neutralized, the appropriate control signals are issued to explosive charge control system 62 which maintains one or more explosive charge(s) 62A. Explosive charges 62A could be deployed from vehicle 50 by means of a release mechanism 62B coupled to explosive charges 62A. Another option would be for some or all of vehicle 50 to be left on the sea floor with charges 62A. In this case, interface 52 could include a disconnection mechanism 52A so that tether 44 can be uncoupled from vehicle 50 if vehicle 50 is to be made expendable. Disconnection mechanism 52A can be actuated via a control signal received from boat 10.

Figure 4:
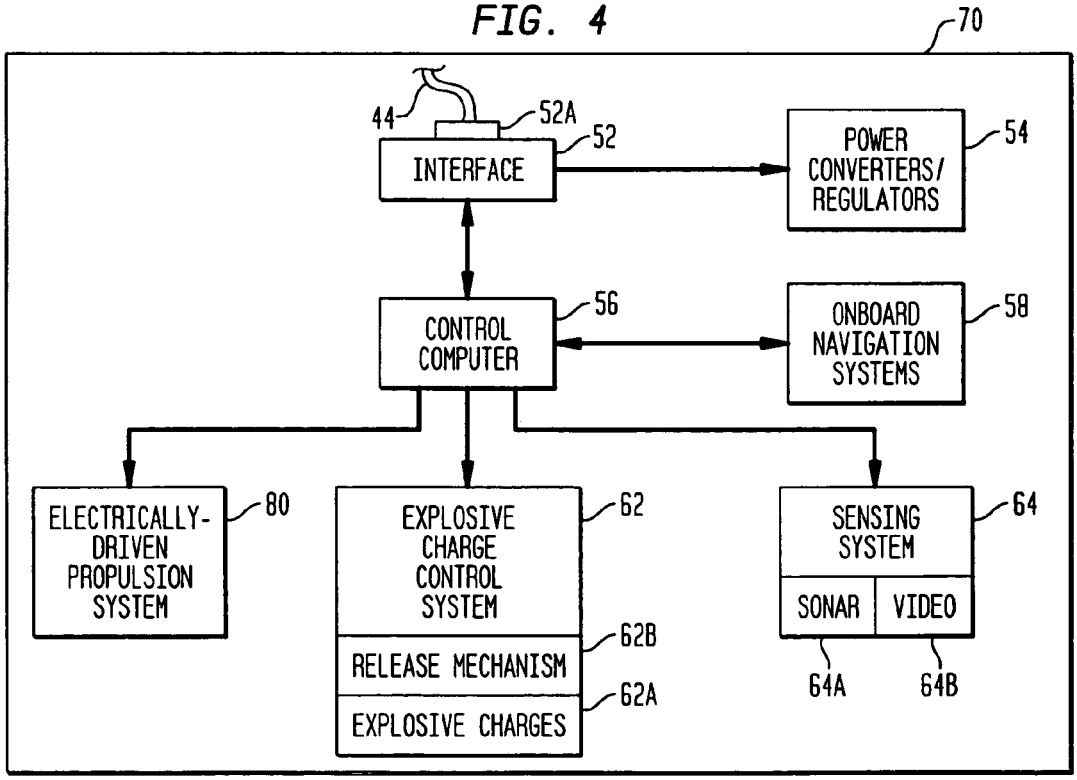
FIG. 4 is a block diagram of the systems maintained onboard an unmanned swimming vehicle transported and deployed by the unmanned surface vehicle in accordance with the present invention.

Referring now to FIG. 4, a (robotic) swimming vehicle 70 would be equipped in a fashion similar to bottom crawling vehicle 50. Accordingly, common reference numerals have been used for those systems that would be identical or nearly identical as would be understood by one of ordinary skill in the art. In contrast, swimming vehicle 70 has an electrically-driven propulsion system 80 which could be realized by any conventional underwater vehicle propulsion system. Once on station, swimming vehicle 70 would be able to perform the same functions as bottom crawling vehicle 50 albeit in the water depths.

Figure 5:
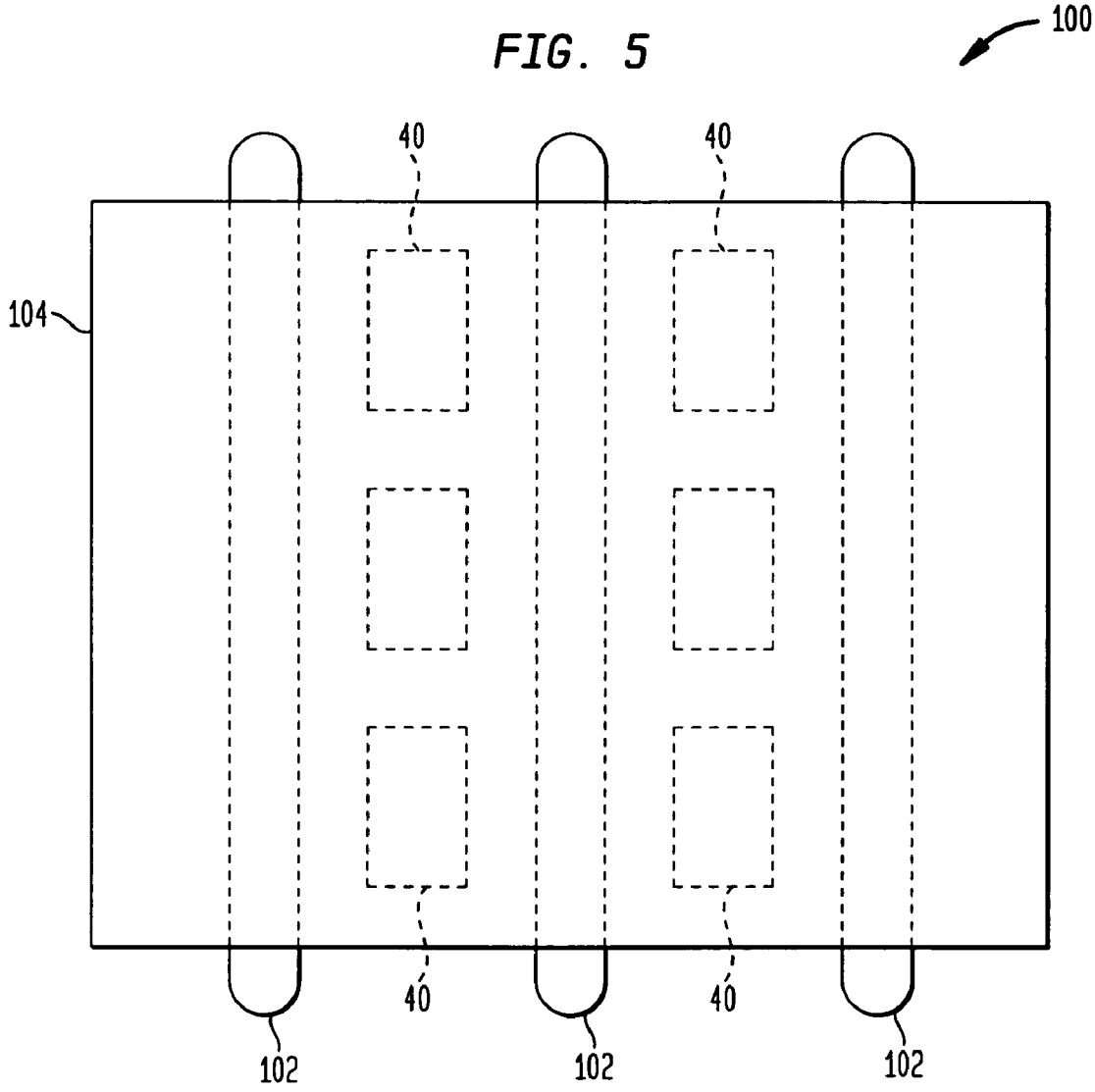
FIG. 5 is a plan view of multiple pontoon boat embodiment of the unmanned surface vehicle.

By way of example, FIG. 5 illustrates a design for the present invention's surface vehicle that would be useful for carrying out the functions of the present invention. Specifically, a pontoon boat 100 has two or more pontoons 102 (e.g., three are illustrated) that provide for floatation thereof on the water's surface. In general, pontoon boats have a low profile which is advantageous for covert operations. A deck structure 104 is used to couple pontoons 102 to one another and is used to define hold regions 40 between pontoons 102. In this way, vehicles 50 and/or 70 are stowed between pontoons 102 during travel to and from an area of interest.

The advantages of the present invention are numerous. The system is entirely unmanned thereby insuring that all operational personnel remain safe. By making multiple robotic crawling and swimming vehicles available for a given mission, the system can adapt to a wide variety of changing mission scenarios and operational environments.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. An unmanned system for performing one or more of inspection, identification and neutralization of underwater objects, comprising:

at least one remotely-operated robotic vehicle for operation underneath a water's surface, each said robotic vehicle having a slave controller, electrical propulsion means, underwater sensing means and explosive charge deploying means;

an unmanned vehicle for operation at a water's surface, said unmanned vehicle having a mother controller, self-propulsion means, navigation means, wireless communication means, electrical energy generation means and means for stowing each said robotic vehicle;

at least one winch mounted on said unmanned vehicle, each said winch being associated with one said robotic vehicle; and an electro-mechanical tether for electrically and mechanically coupling a corresponding one said robotic vehicle to said unmanned vehicle, each said tether mechanically coupled to a corresponding one said winch for control of the paying out and reeling in thereof, each said tether electrically coupling said mother controller to said slave controller and electrically coupling said electrical energy generation means to said electrical propulsion means.

2. An unmanned system as in claim 1 wherein said at least one robotic vehicle comprises a plurality of vehicles that can traverse the sea bottom.

3. An unmanned system as in claim 1 wherein said at least one robotic vehicle comprises a plurality of swimming vehicles.

4. An unmanned system as in claim 1 wherein said at least one robotic vehicle comprises:

at least one vehicle that can traverse the sea bottom; and at least one swimming vehicle.

5. An unmanned system as in claim 1 wherein said unmanned vehicle has a multiple pontoon hull, and wherein each said robotic vehicle is stowed within said multiple pontoon hull when said tether associated therewith is reeled in on said winch associated therewith.

6. An unmanned system as in claim 1 wherein said navigation means includes a GPS receiver system.

7. An unmanned system as in claim 1 wherein said underwater sensing means includes at least one sonar sensor and a video camera.

8. An unmanned system as in claim 1 wherein said self-propulsion means is coupled to and supplies mechanical power for said electrical energy generation means.

9. An unmanned system for performing one or more of inspection, identification and neutralization of underwater objects, comprising:

at least one first type of vehicle having explosive charges maintained thereon, each of said first type of vehicle equipped for traveling on the bottom of a body of water;

at least one second type of vehicle having explosive charges maintained thereon, each of said second type of vehicle equipped for swimming in a body of water under the surface thereof;

an unmanned boat having multiple pontoons for the floatation thereof, said boat equipped for navigated travel on water and for control of each of said first type of vehicle and said second type of vehicle; and an electro-mechanical tethering system mounted on said boat for (i) controlling the individual paying out of each of said first type of vehicle and said second type of vehicle from between said pontoons of said boat, (ii) controlling the individual reeling in of each of said first type of vehicle and said second type of vehicle to stowed positions between said pontoons of said boat, and (iii) electrically coupling said boat to each of said first type of vehicle and said second type of vehicle for the supply of electrical power and control signals thereto.

10. An unmanned system as in claim 9 wherein said boat includes:

a GPS receiver system for determining the location of said boat; and a wireless communication system coupled to said GPS receiver system for transmitting the location of said boat and for receiving navigation control signals for said boat from a remote location.

11. An unmanned system as in claim 9 wherein said boat includes:

a self-propulsion system that generates mechanical power for said navigated travel; and a generator system coupled to said self-propulsion system for converting a portion of said mechanical power to said electrical power supplied to each of said first type of vehicle and said second type of vehicle.

12. An unmanned system according to claim 9 wherein each of said first type of vehicle and said second type of vehicle includes means for releasing said explosive charges maintained thereon.

13. An unmanned system as in claim 9 wherein each of said first type of vehicle and said second type of vehicle includes means for disconnecting from said electro-mechanical tethering system when commanded by one of said control signals received from said boat.

14. An unmanned system as in claim 9 wherein each of said first type of vehicle and said second type of vehicle includes means for sensing and imaging underwater objects.

15. An unmanned system for performing one or more of inspection, identification and neutralization of underwater objects, comprising:

at least one first type of vehicle having explosive charges maintained thereon, each of said first type of vehicle equipped for traveling on the bottom of a body of water;

at least one second type of vehicle having explosive charges maintained thereon, each of said second type of vehicle equipped for swimming in a body of water under the surface thereof;

an unmanned boat having multiple pontoons for the floatation thereof, said boat equipped for navigated travel on water and for control of each of said first type of vehicle and said second type of vehicle;

a GPS receiver system mounted on said boat for determining the location of said boat;

a wireless communication system mounted on said boat and coupled to said GPS receiver system for transmitting the location of said boat and for receiving navigation control signals for said boat from a remote location;

a self-propulsion system mounted on said boat that generates mechanical power for said navigated travel;

a generator system mounted on said boat and coupled to said self-propulsion system for converting a portion of said mechanical power to electrical power; and an electro-mechanical tethering system mounted on said boat for (i) controlling the individual paying out of each of said first type of vehicle and said second type of vehicle from between said pontoons of said boat, (ii) controlling the individual reeling in of each of said first type of vehicle and said second type of vehicle to stowed positions between said pontoons of said boat, and (iii) electrically coupling said boat to each of said first type of vehicle and said second type of vehicle for the supply of said electrical power and control signals thereto.

16. An unmanned system according to claim 15 wherein each of said first type of vehicle and said second type of vehicle includes means for releasing said explosive charges maintained thereon.

17. An unmanned system as in claim 15 wherein each of said first type of vehicle and said second type of vehicle includes means for disconnecting from said electro-mechanical tethering system when commanded by one of said control signals received from said boat.

18. An unmanned system as in claim 15 wherein each of said first type of vehicle and said second type of vehicle includes means for sensing and imaging underwater objects.

* * * * *